United States Patent [19]

Humphreys et al.

[11] Patent Number: 4,642,198

[45] Date of Patent: Feb. 10, 1987

[54] LIQUID BLEACHING COMPOSITIONS

[75] Inventors: Robert W. Humphreys, Pennsauken, N.J.; Adrian W. Walker, Irby, United Kingdom; Robin J. Green, Voorschoten; Stephen W. Russell, Maassluis, both of Netherlands

[73] Assignee: Lever Brothers Company, New York, N.Y.

[21] Appl. No.: 727,494

[22] Filed: Apr. 26, 1985

[30] Foreign Application Priority Data

May 1, 1984 [GB] United Kingdom ..... 8411161
Dec. 18, 1984 [GB] United Kingdom ..... 8431873

[51] Int. Cl.[4] ..... C11D 3/395

[52] U.S. Cl. ..... 252/94; 252/95; 252/96; 252/136; 252/145; 252/186.2; 252/186.23; 252/186.26

[58] Field of Search ..... 252/94, 95, 96, 97, 252/99, 136, 145, 186.2, 186.23, 186.26

[56] References Cited

U.S. PATENT DOCUMENTS

| | | | |
|---|---|---|---|
| 3,658,712 | 4/1972 | Lindner et al. | 252/99 |
| 3,956,159 | 5/1976 | Jones | 252/186.26 |
| 3,996,152 | 12/1976 | Edwards et al. | 252/186.26 |
| 4,017,412 | 4/1977 | Bradley | 252/186.26 |

FOREIGN PATENT DOCUMENTS

| | | |
|---|---|---|
| 0176124 | 2/1986 | European Pat. Off. . |
| 167733 | 10/1982 | Japan . |

*Primary Examiner*—Paul Lieberman
*Assistant Examiner*—Hoa Van Le
*Attorney, Agent, or Firm*—Milton L. Honig; James J. Farrell

[57] ABSTRACT

Aqueous liquid bleaching compositions comprising a solid, particulate, substantially water-insoluble organic peroxy acid, e.g. diperoxydodecanedioic acid, stably suspended in an acidic surfactant structured liquid comprising a surfactant, an electrolyte and water in the substantial absence of a thickening agent.

13 Claims, No Drawings

LIQUID BLEACHING COMPOSITIONS

This invention relates to aqueous liquid bleaching compositions which can be used for effective bleaching of fabrics and hard surfaces or other substrates.

The aqueous bleaching compositions of the invention comprise a solid, substantially water-insoluble organic peroxy acid as the bleaching agent.

Organic peroxy acids, as a class, are quite effective bleaches. The peroxy acids usable in the present invention are solid and substantially water-insoluble compounds. By "substantially water-insoluble" is meant herein a water-solubility of less than about 1% by weight at ambient temperature. In general, peroxy acids containing at least about 7 carbon atoms are sufficiently insoluble in water for use herein.

These materials have the general formula:

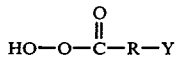

wherein R is an alkylene or substituted alkylene group containing from 6 to about °carbon atoms or a phenylene or substituted phenylene group, and Y is hydrogen, halogen, alkyl, aryl or

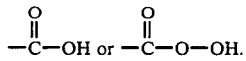

The organic peroxy acids usable in the present invention can contain either one or two peroxy groups and can be either aliphatic or aromatic. When the organic peroxy acid is aliphatic, the unsubstituted acid has the general formula:

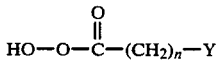

where Y can be, for example, H, $CH_3$, $CH_2Cl$, COOH, or COOOH; and n is an integer from 6 to 20.

When the organic peroxy acid is aromatic, the unsubstituted acid has the general formula:

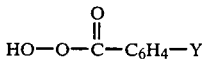

wherein Y is hydrogen, alkyl, alkylhalogen or halogen, or COOH or COOOH.

Typical monoperoxy acids useful herein include alkyl peroxy acids, alkenyl peroxy acids and aryl peroxy acids such as:

(i) peroxybenzoic acid and ring-substituted peroxybenzoic acids, e.g. peroxy-α-naphthoic acid (ii) aliphatic and substituted aliphatic monoperoxy acids, e.g. peroxylauric acid and peroxystearic acid.

Typical diperoxy acids useful herein include alkyl diperoxy acids, alkenyl diperoxy acids and aryldiperoxy acids, such as;

(iii) 1,12-diperoxydodecanedioic acid.

(iv) 1,9-diperoxyazelaic acid.

(v) diperoxybrassylic acid; diperoxysebacic acid and diperoxyisophthalic acid.

(vi) 2-decyldiperoxybutane-1,4-dioic acid.

PRIOR ART

Aqueous bleaching compositions comprising such solid, substantially water-insoluble organic peroxy acids have been proposed in U.S. Pat. No. 3,996,152 and U.S. Pat. No. 4,017,412. The compositions according to these patents are, however, thickened or gel-like products using starch or non-starch organic/inorganic thickening agents.

A major drawback of thickened or gel-like systems of the type as described in these prior art patents is that they are of very high viscosity and clearly not conveniently pourable in order to provide the ability to carry the solid peroxy acid in stable suspension. Liquids of lower viscosity, which may possibly be prepared with very low levels of thickening agents and which may be easily pourable, will either be incapable of suspending solid peroxy acids (e.g. liquids thickened with linear polymer such as linear polyacrylamides) or will not exhibit good storage stability owing to breakdown of the polymer suspending network.

Another drawback is that most, if not all, of the suspending or thickening polymers used in these patents are quite electrolyte intolerant, which means that electrolytes can cause rapid separation. Thus, the systems according to these patents are limited to compositions consisting of peroxy acid, water, and a thickening agent with very limited amount of added salts. If, pourable suspended peroxy acid compositions containing very low levels of polymer or starch thickener (i.e. $<1\%$ ) are taken to dryness, as might occur if a consumer spills a sample or if drops of the formulation migrate down the side of the bottle, one is left with dry, solid, concentrated peroxy acid, which could be very hazardous and dangerous.

A further drawback is that formulations as prepared according to U.S. Pat. Nos. 3,996,152 and 4,017,412 generally show storage stability problems at elevated temperatures.

DESCRIPTION OF THE INVENTION

It is an object of the present invention to provide an improved aqueous liquid bleaching composition comprising a solid, substantially water-insoluble organic peroxy acid, wherein the above drawbacks are mitigated to a substantial degree.

It is another object of the invention to provide a chemically and physically stable and easily pourable aqueous suspension of a solid, substantially water-insoluble organic peroxy acid.

These and other objects, which will be clear from the further description of the invention, can be achieved by having the solid, particulate, substantially water-insoluble organic peroxy acid as defined hereinbefore, suspended in an acidic aqueous surfactant structured liquid.

Aqueous surfactant structured liquids are capable of suspending solid particles without the need of a thickening agent and can be obtained by using a single surfactant or mixtures of surfactants in combination with an electrolyte.

The preparation of surfactant-based suspending liquids is known in the art and normally requires a nonionic and/or an anionic surfactant and an electrolyte, though other types of surfactant or surfactant mixtures, such as the cationics and zwitterionics, can also be used. Indeed, various surfactants or surfactant pairs or mixtures can be used in combination with several different electrolytes, but it should be appreciated that electrolytes which would easily be oxidised by peroxy acids, such as chlorides, bromides and iodides, and those which are not compatible with the desired acid pH range, e.g. carbonates and bicarbonates, should preferably be excluded from the peroxy acid suspending surfactant liquid compositions of the invention.

Examples of different surfactant/electrolyte combinations suitable for preparing the peroxy acid suspending surfactant structured liquids are:

(a) surfactants:

(i) coconut diethanolamide/alkylbenzene sulphonate (ii) $C_9$–$C_{16}$ alcohol ethoxylate/alkylbenzene sulphonate;

(iii) lauryl ethersulphate/alkylbenzene sulphonate;

(iv) alcohol ether sulphate; in combination with:

(b) electrolytes:

(i) sodium sulphate and/or (ii) sodium nitrate.

The surfactant structured liquids capable of suspending the peroxy acid include both the relatively low apparent viscosity, lamellar phase surfactant structured liquids and the higher apparent viscosity surfactant structured liquids with structuring resulting from other phase types, e.g. hexagonal phase, the viscosity of which may be in the range of from about 50 to 20,000 centipoises (0.05 to 20 Pascal seconds) measured at a shear rate of 21 second$^{-1}$ at 25° C.

Accordingly, aqueous liquid products having a viscosity in the above range are encompassed by the invention, though in most cases products having a viscosity of from about 0.20 PaS, particularly from 0.25 to 12 PaS, are preferred.

Although the primary objective of the present invention is to provide a stable peroxy acid suspending system in the form of a conveniently pourable thin liquid having a viscosity of up to about 1.5 PaS, preferably up to about 1.0 PaS, the invention is not limited thereto. Also, thicker liquids can be prepared according to the invention having the solid water-insoluble organic peroxy acid in stable suspension. Hence, such thicker surfactant-based suspending liquid bleaching compositions are within the concept of the present invention.

Accordingly, the invention encompasses aqueous liquid bleaching compositions comprising an effective amount of a solid, particulate, substantially water-insoluble organic peroxy acid stably suspended in an aqueous liquid containing a surfactant and an electrolyte, said compositions having an acid pH in the range of from 1 to 6.5, preferably from 2 to 5.

The particle size of the peroxy acid used in the present invention is not crucial and can be from about 1 to 2000 microns although a small particle size is favoured for laundering application.

The composition of the invention may contain from about 1 to 40% by weight of the peroxy acid, preferably from 2.5 to about 30% by weight.

A preferred peroxy acid is 1,12-diperoxydodecanedioic acid (DPDA).

As explained, the surfactants usable in the present invention can be anionic, nonionic, cationic, zwitterionic or soap in nature or mixtures thereof. Preferred surfactants are anionics, nonionics and/or soap. Such usable surfactants can be any well-known detergent-active material.

The anionics comprise the well-known anionic surfactant of the alkyl aryl sulphonate type, the alkyl sulphate and alkyl ether sulphate types, the alkane and alkene sulphonate type etc. In these surfactants the alkyl radicals may contain from 9–20 carbon atoms. Numerous examples of such materials and other types of surfactants can be found in Schwartz, Perry, Vol. II, 1958, "Detergents and Surface Active Agents".

Specific examples of suitable anionic surfactants include sodium lauryl sulphate, potassium dodecyl sulphonate, sodium dodecyl benzene sulphonate, sodium salt of lauryl polyoxyethylene sulphate, dioctyl ester of sodium sulphosuccinic acid, sodium lauryl sulphonate.

The nonionics comprise ethylene oxide and/or propylene oxide condensation products with alcohols, alkylphenol, fatty acids, fatty acid amides. These products generally can contain from 5 to 30 ethylene oxide and/or propylene oxide groups. Fatty acid mono- and dialkylolamides, as well as tertiary amine oxides are also included in the terminology of nonionic detergent-active materials.

Specific examples of nonionic detergents include nonyl phenol polyoxyethylene ether, tridecyl alcohol polyoxyethylene ether, dodecyl mercaptan polyoxyethylene thioether, the lauric ester of polyethylene glycol, $C_{12}$–$C_{15}$ primary alcohol/7 ethylene oxides, the lauric ester of sorbitan polyoxyethylene ether, tertiary alkyl amine oxide and mixtures thereof.

Other examples of nonionic surfactants can be found in Schwartz, Perry, Vol. II, 1958, "Detergents and Surface Active Agents" and Schick, Vol. I, 1967, "Nonionic Surfactants".

The cationic detergents which can be used in the present invention include quaternary ammonium salts which contain at least one alkyl group having from 12 to 20 carbon atoms. Although the halide ions are the preferred anions, other suitable anions include acetate, phosphate, sulphate, nitrite, and the like.

Specific cationic detergents include distearyl dimethyl ammonium chloride, stearyl dimethyl benzyl ammonium chloride, stearyl trimethyl ammonium chloride, coco dimethyl benzyl ammonium chloride, dicoco dimethyl ammonium chloride, cetyl pyridinium chloride, cetyl trimethyl ammonium bromide, stearyl amine salts that are soluble in water such as stearyl amine acetate and stearyl amine hydrochloride, stearyl dimethyl amine hydrochloride, distearyl amine hydrochloride, alkyl phenoxyethoxyethyl dimethyl ammonium chloride, decyl pyridinium bromide, pyridinium chloride derivative of the acetyl amino ethyl esters of lauric acid, lauryl trimethyl ammonium chloride, decyl amine acetate, lauryl dimethyl ethyl ammonium chloride, the lactic acid and citric acid and other acid salts of stearyl-1-amidoimidazoline with methyl chloride, benzyl chloride, chloroacetic acid and similar compounds, mixtures of the foregoing, and the like.

Zwitterionic detergents include alkyl-$\beta$-iminodipropionate, alkyl-$\beta$-aminopropionate, fatty imidazolines, betaines, and mixtures thereof.

Specific examples of such detergents are 1-coco-5-hydroxyethyl-5-carboxymethyl imidazoline, dodecyl-$\beta$-alanine, the inner salt of 2-trimethylamino lauric acid, and N-dodecyl-N,N-dimethyl amino acetic acid.

The total surfactant amount in the liquid bleaching composition of the invention may vary from 2 to 50% by weight, preferably from 5 to 35% by weight, depending on the purpose of use. In the case of suspending liquids comprising an anionic and a nonionic surfactant the ratio thereof may vary from about 10:1 to 1:10. The term anionic surfactant used in this context includes the alkali metal soaps of synthetic or natural long-chain fatty acids having normally from 12 to 20 carbon atoms in the chain.

The total level of electrolyte(s) present in the composition to provide structuring may vary from about 1.5 to about 30%, preferably from 2.5 to 25% by weight.

Since most commercial surfactants contain metal ion impurities (e.g. iron and copper) that can catalyse peroxy acid decomposition in the liquid bleaching composition of the invention, those surfactants are preferred which contain a minimal amount of these metal ion impurities. The peroxy acid instability results in fact from its limited, though finite, solubility in the suspending liquid base and it is this part of the dissolved peroxy acid which reacts with the dissolved metal ions. It has been found that certain metal ion complexing agents can remove metal ion contaminants from the composition of the invention and so retard the peroxy acid decomposition and markedly increase the lifetime of the composition.

A further improvement of the chemical stability of the peroxy acid can be achieved by applying some means of protection e.g. coating, to the solid peroxy acid particles from the surrounding medium. In that case other non-compatible electrolytes, such as halides, can also be used without the risk of being oxidised by the peroxy acid during storage.

Examples of useful metal ion complexing agents include dipicolinic acid, with or without a synergistic amount of a water-soluble phosphate salt; dipicolinic acid N-oxide; picolinic acid; ethylene diamine tetraacetic acid (EDTA) and its salts; various organic phosphonic acids or phosphonates such as ethylene diamine tetra-(methylene phosphonic acid) and diethylene triamine penta-(methylene phosphonic acid).

Other metal complexing agents known in the art may also be useful, the effectiveness of which may depend strongly on the pH of the final formulation. Generally, and for most purposes, levels of metal ion complexing agents in the range of from about 10–1000 ppm are already effective to remove the metal ion contaminants.

OPTIONAL INGREDIENTS

In addition to the components discussed above, the liquid bleaching compositions of the invention may also contain certain optional ingredients in minor amounts, depending upon the purpose of use. Typical examples of optional ingredients are suds-controlling agents, fluorescers, perfumes, colouring agents, abrasives, hydrotropes and antioxidants. However, any such optional ingredient may be incorporated provided that its presence in the composition does not significantly reduce the chemical and physical stability of the peroxy acid in the suspending system.

The compositions of the invention, as opposed to the thickened gel-like compositions of the art, are much safer in handling in that, if they are taken to dryness, one is left with peroxy acid diluted with a significant amount of a surfactant and a highly hydrated salt, which should be safe.

The compositions of the invention are also chemically stable, which must be surprising considering the fact that peroxy acids are suspended in a medium containing such a high level of organic material (i.e. about and above 10% by weight normally of an organic surfactant).

The compositions of the invention, because of their nature, may have a wide range of applications. As such can be named:

(a) a laundry bleach additive
(b) a light duty liquid
(c) a hygienic hard-surface cleaner, including lavatory cleaning
(d) a general purpose household cleaner
(e) a liquid low pH abrasive cleaner.

In terms of product forms they can be presented as:

(i) a single component liquid product, for example as a light duty liquid or a bleach additive in laundering operations;
(ii) a formulation in combination with a heavy duty built liquid detergent contained in a two-compartment bottle, to give a complete heavy duty liquid detergent delivering a low temperature bleach;
(iii) a bleach formulation packed in sachets for use with or without a liquid detergent formulation in sachets;
(iv) delivered from wipes alone or in combination with a liquid detergent also delivered from wipes;
(v) delivered as a pair with a liquid detergent composition from a two-bags-in-box system;
(vi) packed in a sachet and delivered therefrom in combination with a heavy duty powdered detergent.
(vi) packed separately from an enzymatic formulation and combined at the point of use.

The invention will now be illustrated by way of the following Examples:

EXAMPLE I

The following liquid bleach compositions were prepared by suspending 1,12-diperoxydodecanedioic acid (DPDA) in various amounts in a surfactant structured liquid composition.

| | % by weight | | | | | | | |
|---|---|---|---|---|---|---|---|---|
| Ingredients | (a) | (b) | (c) | (d) | (e) | (f) | (g) | (h) |
| Sodium alkylbenzene sulphonate | 6.825 | 6.8 | 6.72 | 6.685 | 6.65 | 6.58 | 6.475 | 6.8 |
| $C_{12}$–$C_{15}$ primary alcohol/ ethylene oxide | 2.925 | 2.9 | 2.88 | 2.865 | 2.85 | 2.82 | 2.775 | 2.7 |
| Anhydrous sodium sulphate | 6.825 | 6.8 | 6.72 | 6.685 | 6.65 | 6.58 | 6.475 | 6.3 |
| 1,12-diperoxy-dodecanedioic acid (DPDA) | 2.5 | 3.0 | 4.0 | 4.5 | 5.0 | 6.0 | 7.5 | 10.0 |
| Water + $H_2SO_4$ for pH adjusted to 2–5 | | | | | balance | | | |
| Viscosity (PaS) | 0.429 | — | — | — | 0.482 | — | 0.554 | 0.622 |

All these liquids were stable and easily pourable.

All these liquids were stable and easily pourable.

Storage Stability Data

| Initial Wt. % DPDA | Storage Temp. (°C.) | % Peracid Remaining | | | |
|---|---|---|---|---|---|
| | | 66 hr | 167 hr | | 688 hr |
| 2.5 | 40 | 67 | 64 | | 3 |
| 5.0 | | 93 | 83 | | 47 |
| 7.5 | | 96 | 89 | | 65 |
| 10.0 | | 97 | 93 | | 85 |
| | | 114 hr | 302 hr | 604 hr | 1502 hr |
| 3.0 | 30 | 95 | 88 | 77 | 49 |
| 4.0 | | 98 | 96 | 82 | 61 |
| 5.0 | | 97 | 92 | 84 | 66 |
| 6.0 | | 93 | 90 | 84 | 68 |
| 3.0 | 40 | 82 | 48 | 7 | d |

-continued

| Storage Stability Data | | | | | |
|---|---|---|---|---|---|
| Initial Wt. % DPDA | Storage Temp. (°C.) | % Peracid Remaining | | | |
| 4.0 | | 85 | 59 | 26 | d |
| 5.0 | | 87 | 67 | 42 | d |
| 6.0 | | 90 | 75 | 57 | d |

d = decomposed completely

The above accelerated storage stability data show that also the peroxy acid stability in the liquids of the invention is satisfactory.

EXAMPLE II

The following liquid bleach compositions were prepared by suspending 1,12-diperoxydodecanedioic acid (DPDA) in various amounts in another surfactant structured liquid composition.

| | % by weight | | | | | |
|---|---|---|---|---|---|---|
| Ingredients | (a) | (b) | (c) | (d) | (e) | (f) |
| Sodium alkylbenzene sulphonate | 5.4 | 5.253 | 5.2 | 5.1 | 5.0 | 4.125 |
| Sodium $C_{12}$–$C_{15}$ alcohol/3 ethylene oxide sulphate | 4.4 | 4.298 | 4.3 | 4.2 | 4.1 | 3.375 |
| Anhydrous sodium sulphate | 13.65 | 13.37 | 13.3 | 12.95 | 12.6 | 10.5 |
| DPDA | 2.5 | 4.5 | 5.0 | 7.5 | 10.0 | 25.0 |
| Water + $H_2SO_4$ for pH adjusted to 2–5 | | | balance | | | |
| Viscosity (PaS) | 0.325 | — | 0.409 | 0.460 | 0.594 | 2.420 |

All these liquids were stable and, except for (f), easily pourable.

| Storage Stability Data | | | | | |
|---|---|---|---|---|---|
| Initial Wt. % DPDA | Storage Temp. (°C.) | % Peracid Remaining | | | |
| | | 3 days | 7 days | 12 days | 18 days |
| 2.5 | 20 | 100 | 100 | 100 | 94 |
| 5.0 | | 100 | 100 | 98 | 97 |
| 7.5 | | 100 | 100 | 98 | 97 |
| 10.0 | | 100 | 100 | 96 | 95 |
| 2.5 | 30 | 93 | 81 | 71 | 71 |
| 5.0 | | 100 | 86 | 81 | 89 |
| 7.5 | | 94 | 92 | 84 | 93 |
| 10.0 | | 94 | 94 | 89 | 83 |
| 2.5 | 40 | 46 | 18 | 17 | 0 |
| 5.0 | | 66 | 52 | 47 | 36 |
| 7.5 | | 93 | 85 | 89 | 83 |
| 10.0 | | 96 | 85 | 86 | 85 |

EXAMPLE III

The following liquid bleach compositions were prepared and stored at 20° C., 30° C. and 40° C.

| | % by weight | | | | |
|---|---|---|---|---|---|
| Ingredients | (a) | (b) | (c) | (d) | (e) |
| Sodium alkylbenzene sulphonate | 3.413 | 3.343 | 3.325 | 3.238 | 3.15 |
| $C_{12}$–$C_{15}$ primary alcohol/7 ethylene oxide | 1.463 | 1.433 | 1.425 | 1.388 | 1.35 |
| Anhydrous sodium sulphate | 9.75 | 9.55 | 9.5 | 9.25 | 9.0 |
| DPDA | 2.5 | 4.5 | 5.0 | 7.5 | 10.0 |
| Water + $H_2SO_4$ for pH adjusted to 2–5 | | | balance | | |
| Viscosity (PaS) | 0.057 | — | 0.074 | 0.087 | 0.158 |

No separation was observed during storage.

| Storage Stability Data | | | | | |
|---|---|---|---|---|---|
| Initial Wt. % DPDA | Storage Temp. (°C.) | % Peracid Remaining | | | |
| | | 3 days | 7 days | 12 days | 18 days |
| 2.5 | 20 | 100 | 100 | 96 | 95 |
| 5.0 | | 100 | 100 | 100 | 98 |
| 7.5 | | 100 | 100 | 96 | 94 |
| 10.0 | | 100 | 100 | 96 | 96 |
| 2.5 | 30 | 100 | 93 | 79 | 80 |
| 5.0 | | 100 | 89 | 88 | 83 |
| 7.5 | | 100 | 92 | 92 | 93 |
| 10.0 | | 100 | 93 | 92 | 91 |
| 2.5 | 40 | 83 | 53 | 44 | 26 |
| 5.0 | | 88 | 69 | 58 | 49 |
| 7.5 | | 91 | 74 | 73 | 74 |
| 10.0 | | 98 | 79 | 80 | 75 |

The above storage stability data show that the liquid compositions are of excellent chemical stability.

EXAMPLES IV AND V

The following liquid bleaching compositions were prepared and stored at 40° C. for 30 days. The DPDA remaining was determined at regular intervals.

| Example IV | | Example V | |
|---|---|---|---|
| Ingredients | % by weight | Ingredients | % by weight |
| Sodium alkylbenzene sulphonate | 6.305 | Sodium lauryl sulphate | 7.76 |
| $C_{12}$–$C_{15}$ primary alcohol/7 ethylene oxide | 3.395 | Tertiary alkylamine oxide | 1.94 |
| Trisodium citrate dihydrate | 7.76 | Anhydrous sodium sulphate | 12.61 |
| DPDA | 3.0 | DPDA | 3.0 |
| Water + $H_2SO_4$ for pH adjusted to 4.5 | balance | Water for pH adjusted to 4.5 | balance |
| Viscosity (PaS) | 0.361 | Viscosity (PaS) | 0.137 |

Both compositions were stable and easily pourable thin liquids.

| Storage Stability Data | | | | | | | |
|---|---|---|---|---|---|---|---|
| Example N° | Initial Wt. % DPDA | Storage Temp. (°C.) | % Peracid Remaining | | | | |
| | | | 6 days | 9 days | 17 days | 24 days | 30 days |
| IV | 3 | 40 | 94 | 89 | 76 | 66 | 54 |
| | | | 3 days | 7 days | 13 days | 20 days | 28 days |
| V | 3 | 40 | 86 | 76 | 65 | 54 | 42 |

The above accelerated storage stability data show that the peroxy acid DPDA is chemically stable in the liquid composition of the invention.

EXAMPLES VI AND VII

The following liquid bleach compositions were prepared. Diperoxyazelaic acid (DPAA) was used as the peroxy acid in Example VI. In Example VII p-nitroperoxybenzoic acid was used as the peroxy acid.

Compositions for Example VI

| Ingredients | % by weight (a) | (b) | (c) | (d) | (e) |
|---|---|---|---|---|---|
| Sodium alkylbenzene sulphonate | 6.825 | 6.755 | 6.65 | 6.475 | 6.3 |
| $C_{12}$-$C_{15}$ primary alcohol/7 ethylene oxide | 2.925 | 2.895 | 2.85 | 2.775 | 2.7 |
| Anhydrous sodium sulphate | 6.825 | 6.755 | 6.65 | 6.475 | 6.3 |
| Diperoxyazelaic acid (DPAA) | 2.5 | 3.5 | 5.0 | 7.5 | 10.0 |
| Dipicolinic acid | 0.1 | 0.1 | 0.1 | 0.1 | 0.1 |
| Sodium dihydrogen phosphate dihydrate | 0.46 | 0.46 | 0.46 | 0.46 | 0.46 |
| Water + $H_2SO_4$ for pH adjusted to 2-5 | | | balance | | |
| Viscosity (PaS) | 0.337 | — | 0.408 | 0.372 | 0.400 |

Compositions for Example VII

| Ingredients | % by weight (a) | (b) | (c) | (d) |
|---|---|---|---|---|
| Sodium alkylbenzene sulphonate | 6.825 | 6.65 | 6.475 | 6.3 |
| $C_{12}$-$C_{15}$ primary alcohol/7 ethylene oxide | 2.925 | 2.85 | 2.775 | 2.7 |
| Anhydrous sodium sulphate | 6.825 | 6.65 | 6.475 | 6.3 |
| p-Nitroperoxybenzoic acid (PNPBA) | 2.5 | 5.0 | 7.5 | 10.0 |
| Water + $H_2SO_4$ for pH adjusted to 2-5 | | balance | | |
| Viscosity (PaS) | 0.435 | 0.380 | 0.438 | 0.407 |

All these compositions were stable and easily pourable thin liquids.

Storage Stability Data for Example VI

| Initial Wt. % DPDA | Storage Temp. (°C.) | % Peracid Remaining 2 days | 15 days | 28 days | 38 days |
|---|---|---|---|---|---|
| 2.5 | 20 | 98 | 89 | — | 70 |
| 5.0 | | 98 | 94 | — | 82 |
| 7.0 | | 97 | 94 | — | 83 |
| 10.0 | | 99 | 95 | — | 84 |
| 2.5 | 30 | 93 | 62 | 39 | 18 |
| 5.0 | | 97 | 79 | 63 | 54 |
| 7.5 | | 94 | 82 | 71 | 63 |
| 10.0 | | 97 | 84 | 70 | 66 |

Storage Stability Data for Example VII

| Initial Wt. % DPDA | Storage Temp. (°C.) | % Peracid Remaining 4 days | 10 days |
|---|---|---|---|
| 2.5 | 20 | 65 | 37 |
| 5.0 | | 86 | 70 |
| 7.5 | | 92 | 82 |
| 10.0 | | 94 | 89 |
| 2.5 | 30 | 30 | 9 |

-continued

Storage Stability Data for Example VII

| Initial Wt. % DPDA | Storage Temp. (°C.) | % Peracid Remaining 4 days | 10 days |
|---|---|---|---|
| 5.0 | | 64 | 41 |
| 7.5 | | 81 | 68 |
| 10.0 | | 87 | 75 |

EXAMPLE VIII

The bleaching performance on tea-stained test cloths of one composition from each of the Examples I-VII was determined by measuring the reflectance at 460 nm before and after washing using an Elrepho ® reflectometer. All reflectance readings were corrected for fluorescer deposition. Bleaching is indicated by the increase in reflectance, labelled $\Delta R_{460*}$ in the following table.

TABLE

Bleaching Performance of Structured Surfactant Liquids Containing Suspended Peroxy Acids

| Example N° | Peroxy Acid (Wt. %) | | $\Delta R_{460*}$ 30° C. | 40° C. | 60° C.[a] |
|---|---|---|---|---|---|
| I (d) | DPDA | (4.5) | 6.3 | 10.1 | 12.9 |
| II (b) | DPDA | (4.5) | 7.6 | 12.0 | 12.3 |
| III (b) | DPDA | (4.5) | 9.1 | 12.0 | 12.5 |
| IV | DPDA | (3.0) | 10.3 | 14.2 | 14.8 |
| V | DPDA | (3.0) | 7.6 | 13.0 | 13.9 |
| VI (b) | DPAA | (3.5) | 4.1 | 10.9 | 10.2 |
| VII (b) | PNPBA | (5.0) | 7.6 | 16.2 | 16.4 |

[a]The 30° C. wash was for 30 min. only, the 40° C. and 60° C. washes were full machine cycle (>1 hour).

We claim:

1. An aqueous liquid bleaching composition having a pH of from 1 to 6.5, comprising from 1 to 40% by weight of a solid, particulate, substantially water-insoluble organic peroxy acid stably suspended in a surfactant structured liquid comprising from 2 to 50% by weight of a surfactant, from 1.5 to 30% by weight of an electrolyte and the balance water, said bleaching composition having a viscosity of from 0.05 to 20 PaS measured at a shear rate of 21 sec.$^{-1}$ at 25° C.

2. Bleaching composition according to claim 1, which comprises from 2.5 to 30% by weight of said peroxy acid.

3. Bleaching composition according to claim 1, wherein said surfactant represents from 5 to 35% by weight and said electrolyte represents 2.5 to 25% by weight of the composition.

4. Bleaching composition according to claim 1, wherein said surfactant is selected from anionic surfactants, nonionic surfactants and mixtures thereof.

5. Bleaching composition according to claim 1, wherein said peroxy acid is 1,12-diperoxydodecanedioic acid.

6. Bleaching composition according to claim 1, wherein said viscosity is from 0.05 to 1.5 PaS.

7. Bleaching composition according to claim 6, wherein said viscosity is from 0.2 to 1.0 paS.

8. An aqueous liquid bleaching composition according to claim 1 wherein said surfactant is a mixture of anionic and nonionic surfactants in the respective ratio of 10:1 to 1:10.

9. An aqueous liquid bleaching composition according to claim 8 wherein the anionic surfactant is alkylbenzene sulfonate.

10. An aqueous liquid bleaching composition according to claim 8 wherein the nonionic is selected from the group consisting of fatty acid mono- and dialkylolamides, tertiary amine oxides, ethylene oxide and/or propylene oxide condensation products with alcohols, alkylphenol, fatty acids, fatty acid amides and mixtures thereof.

11. An aqueous liquid bleaching composition according to claim 8 wherein the surfactant is a mixture of alkylbenzene sulfonate and an ethoxylated alcohol.

12. An aqueous liquid bleaching composition according to claim 1 wherein said surfactant is a mixture of at least two anionic surfactants.

13. An aqueous liquid bleaching composition according to claim 12 wherein the surfactant is a mixture of alkylbenzene sulfonate and an alkyl ether sulphate.

* * * * *